US005157871A

United States Patent [19]

Gawa et al.

[11] Patent Number: 5,157,871

[45] Date of Patent: Oct. 27, 1992

[54] SPINDLE ASSEMBLY FOR USE IN A LENS POLISHER

[75] Inventors: Tomohiro Gawa, Hirakata; Katsuyoshi Shingu, Moriguchi; Kiyoshi Mayahara, Hirakata, all of Japan

[73] Assignee: Matsushita Electric Industrial Co., Ltd., Osaka, Japan

[21] Appl. No.: 848,126

[22] Filed: Mar. 9, 1992

[30] Foreign Application Priority Data

Mar. 11, 1991 [JP] Japan ..... 3-44829

[51] Int. Cl.[5] ..... B24B 49/10; B24B 49/16

[52] U.S. Cl. ..... 51/165.71; 51/165.77; 51/119; 51/129

[58] Field of Search ..... 51/165 R, 165.77, 165.76, 51/165.71, 134.5 R, 105 LG, 106 LG, 284 R, 119, 129; 173/4, 6, 7, 11

[56] References Cited

U.S. PATENT DOCUMENTS

| | | | |
|---|---|---|---|
| 4,036,607 | 7/1977 | Freddi | 51/281 R |
| 4,047,343 | 9/1977 | Smith | 51/313 |
| 4,680,998 | 7/1987 | Council, Jr. | 51/284 R |
| 4,974,368 | 12/1990 | Miyamoto et al. | 51/165.75 |
| 5,024,025 | 6/1991 | Kihara et al. | 51/165.77 |
| 5,027,280 | 6/1991 | Ando et al. | 51/134.5 R |
| 5,054,244 | 10/1991 | Takamatsu et al. | 51/165.71 |
| 5,076,026 | 12/1991 | Mizuguchi | 51/317 |

FOREIGN PATENT DOCUMENTS

| | | | |
|---|---|---|---|
| 0795913 | 1/1981 | U.S.S.R. | 51/165.77 |

*Primary Examiner*—Bruce M. Kisliuk
*Assistant Examiner*—Bryan Reichenbach
*Attorney, Agent, or Firm*—Ratner & Prestia

[57] ABSTRACT

A lens polisher intended to polish a glass lens is provided with a spindle assembly having a spindle body, a housing secured to the spindle body, a load cell for monitoring the pressure applied to the lens, and a rotary head rotatably mounted on the housing. The spindle assembly further has an electric magnet secured to the load cell, at least one plate spring resiliently carried by the rotary head, a permanent magnet secured to the plate spring so as to be opposed to and spaced from the electric magnet, and an abrasive tool secured to the plate spring to polish the lens. A control unit is electrically coupled with the electric magnet and the load cell to control the voltage applied to the electric magnet in response to a signal sent from the load cell. The magnetic force generated by the electric magnet and that generated by the permanent magnet respulse to each other so that the abrasive tool may be resiliently biased against the lens during polishing while the pressure applied to the lens is being monitored by the load cell and is being controlled by the control unit.

4 Claims, 4 Drawing Sheets

SPINDLE ASSEMBLY FOR USE IN A LENS POLISHER

BACKGROUND OF THE INVENTION

1. Field of the Invention

The present invention relates to a spindle assembly for use in a polisher for polishing glass lenses during a finishing or polishing processing. The spindle assembly according to the present invention is applicable to almost all the glass lenses, regardless of whether their surfaces to be polished are spherical.

2. Description of the Prior Art

In recent years, optical glass lenses are widely used not only in optical instruments but also in information communication devices, AV (Audio-Visual) devices or the like. There have been strong demands towards miniaturization, lightening, high-functioning, and high accuracy. In particular, an exposure device used in manufacturing semiconductors needs considerably highly accurate glass lenses, and the technique required for polishing lenses is about to exceed the manually controllable range.

When a spherical lens is polished, an abrasive sheet made of, for example, polyurethane is initially bonded to an abrasive tool known as an "abrasive disc", and the abrasive disc is then brought into contact with and ground by a prototype for the finishing thereof while a polishing solution is being poured thereon. Thereafter, the surface of the lens to be polished is brought into contact with and ground by the finished surface of the abrasive disc so that the surface configuration of the abrasive disc may appropriately be transferred onto the surface of the lens with accuracy.

Although it is well known that the accuracy of a lens polished generally depends upon the accuracy in configuration of an abrasive tool, various processing conditions, experiential or experimental parameters or the like exert considerable influence upon the accuracy of the lens. For example, the mesh size of an abrasive sheet, the peripheral speed of an abrasive tool, the pressure to be applied, and the time required for the processing are considered as the processing conditions whereas the concentration and the amount of a polishing solution are considered as the experiential or experimental parameters.

FIG. 1 depicts a conventional spindle assembly comprising an abrasive disc 1 for polishing a lens, a pivot bearing 2 carrying the abrasive disc 1, a universal joint 3 carrying the pivot bearing 2, a shaft 4 of the pivot bearing 2, a flange 5 carrying the shaft 4, and a balance or counter weight 6. The spindle assembly shown in FIG. 1 further comprises a spline shaft 18 and upper and lower guides 16 and 10 for guiding the spline shaft 18 along them when the spline shaft 18 moves up and down. The lower guide 10 is rotatably mounted in a housing 12 via a split spacer 11, a bearing 9, and nuts 7 and 8 whereas the upper guide 16 is secured to a timing pulley 15 driven by a certain driving mechanism (not shown) and is also rotatably mounted in the housing 12 via a bearing 13 and nuts 8 and 14.

A bracket 20 is mounted on the upper end of the spline shaft 18 via a bearing 19 and a nut 8, and a pole 21 carried by a bracket 22 prevents the rotation of the bracket 20. The housing 12 is also carried by the bracket 22, which is secured to an apparatus body (not shown). The bracket 20 is provided with a proximity switch 20*a* for detecting the vertical movement of the bracket 22 relative to the spline shaft 18. A stopper 17 is secured to the spline shaft 18 so that prior to the polishing, the weight of the spline shaft 18 and that of other rotary members are supported by the engagement between the stopper 17 and the upper guide 16.

The spindle assembly having the above-described construction operates as follows.

When the timing pulley 15 receives the rotational force from the driving mechanism, the rotational force is transmitted to the upper guide 16 and the spline shaft 18 because a lower portion of the timing pulley 15 is rotatably mounted in the housing 12 via the bearing 13. On the other hand, because the lower guide 10 is also rotatably mounted in the housing 12 via the bearing 9, the lower guide 10 along with the spacer 11 rotates in synchronization with the spline shaft 18. At this moment, the flange 5 and the balance weight 6 both secured to one end of the spline shaft 18, shaft 4, universal joint 3, pivot bearing 2, and abrasive disc 1 also rotate in a direction shown by an arrow X.

When the abrasive disc 1 along with the bracket 22 is moved downward (in a direction shown by an arrow Z) by the apparatus body, the abrasive disc 1 is brought into partial contact with a lens (not shown) to be polished. When the bracket 22 is further moved downwards, the upper guide 16 departs from the stopper 17 so that the weight of the spline shaft 18 and that of other vertically movable members may be loaded on the lens. As a result, the lower surface of the abrasive disc 1 is brought into contact with the entire upper surface of the lens, and the center line of the abrasive disc 1 and that of the pivot bearing 2 are automatically directed towards the center of curvature of the lens. The downward movement of the bracket 22 relative to the spline shaft 18, which results in the entire contact between the lower surface of the abrasive disc 1 and the upper surface of the lens, is detected by the proximity switch 20*a*. At this moment, supplying a polishing solution causes abrasive grains to expedite the polishing of the lens.

In the above-described construction, however, as a lens to be polished becomes large in diameter or as the more accuracy is requested, it is necessary to enlarge the abrasive disc 1 or to enhance the accuracy in the polishing or finishing. Furthermore, although the static balance of the pressure to be applied to the lens can be controlled by the balance weight 6, it has been impossible to control the dynamic balance. Also, because there is a gap of about several tens μm between the spline shaft 18 and the guides 10 and 16, the rotary shaft dynamically laterally sways during the rotation thereof. It is, therefore, fundamentally difficult to obtain a highly accurate spherical configuration. With such reasoning, the above-described conventional spindle assembly is insufficient for the polishing of a high-accuracy lens having a relatively large diameter.

SUMMARY OF THE INVENTION

The present invention has been developed to overcome the above-described disadvantages.

It is accordingly an object of the present invention to provide an improved spindle assembly capable of polishing a lens having a relatively large diameter with high accuracy.

Another object of the present invention is to provide a spindle assembly of the above-described type capable of performing the partial correction in configuration of a lens.

In accomplishing these and other objects, a spindle assembly according to the present invention comprises a spindle body, a housing secured to the spindle body, a pressure monitoring means accommodated in the housing and secured to the spindle body to monitor the pressure to be applied to a lens, and a rotary head rotatably mounted on the housing. The spindle assembly further comprises an electric magnet secured to the pressure monitoring means, at least one plate spring resiliently carried by the rotary head, a permanent magnet secured to the plate spring so as to be opposed to and spaced from the electric magnet, and an abrasive tool secured to the plate spring to polish the lens. The spindle assembly also comprises a control means electrically coupled with the electric magnet and the pressure monitoring means so as to control the voltage applied to the electric magnet in response to a signal sent from the pressure monitoring means.

In this construction, the magnetic force generated by the electric magnet and that generated by the permanent magnet repulse to each other, thereby resiliently biasing the abrasive tool against the lens during polishing while the pressure applied to the lens is being monitored by the pressure monitoring means and is being controlled by the control means.

Preferably, the plate spring has a plurality of concentric round rows of a pair of circumferentially extending arcuate openings defined therein in coaxial relationship with the plate spring.

The spindle assembly according to the present invention can control the dynamic pressure to be applied to the lens and needs no vertically movable spline shaft. The use of the plate spring can prevent the radial movement of the abrasive tool, thus enabling the partial correction in configuration of the lens with high accuracy.

BRIEF DESCRIPTION OF THE DRAWINGS

These and other objects and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
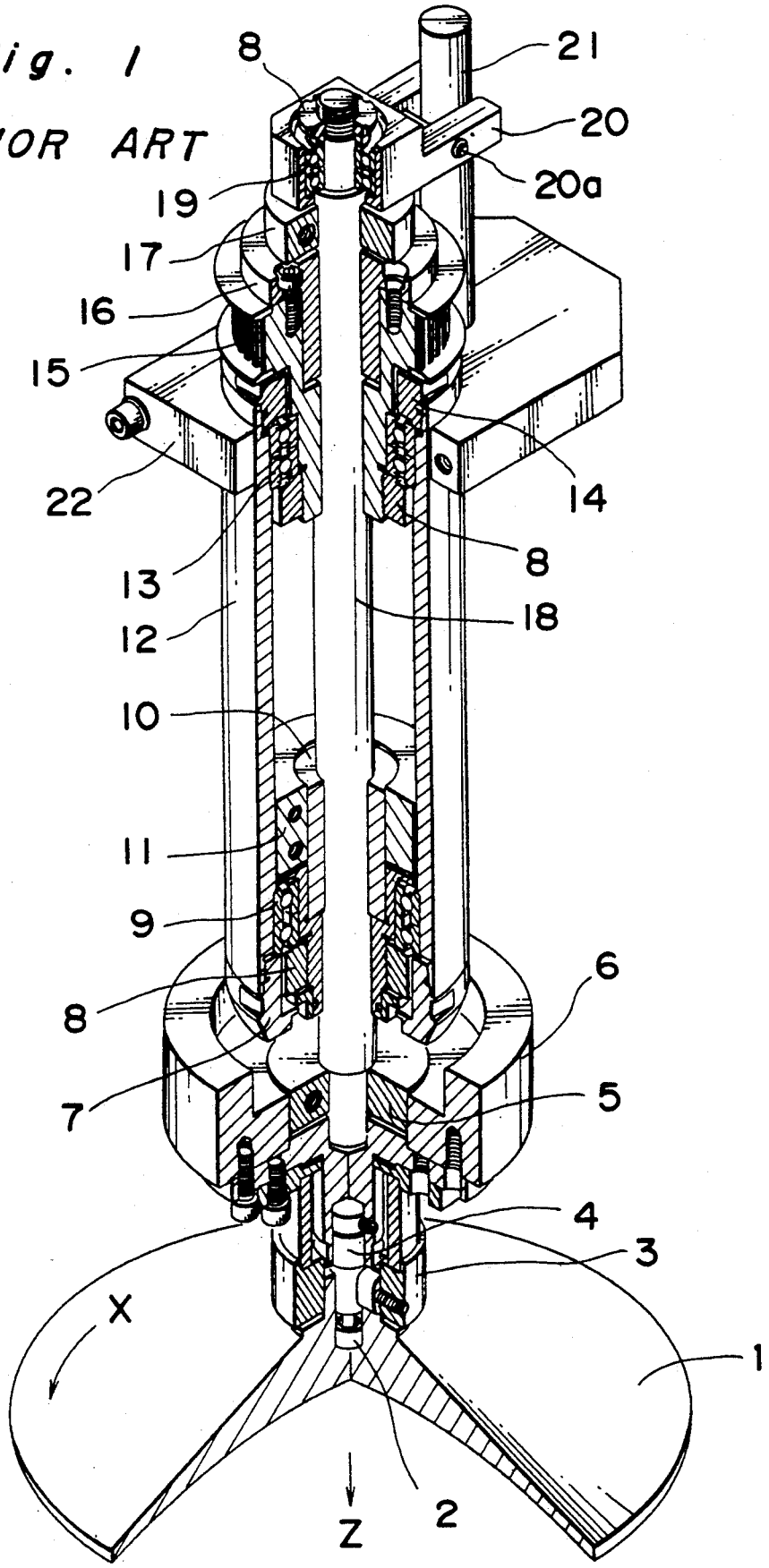
Fig. 1 PRIOR ART
FIG. 1 is a perspective view, partly in section, of a conventional spindle assembly.
Figure 2:
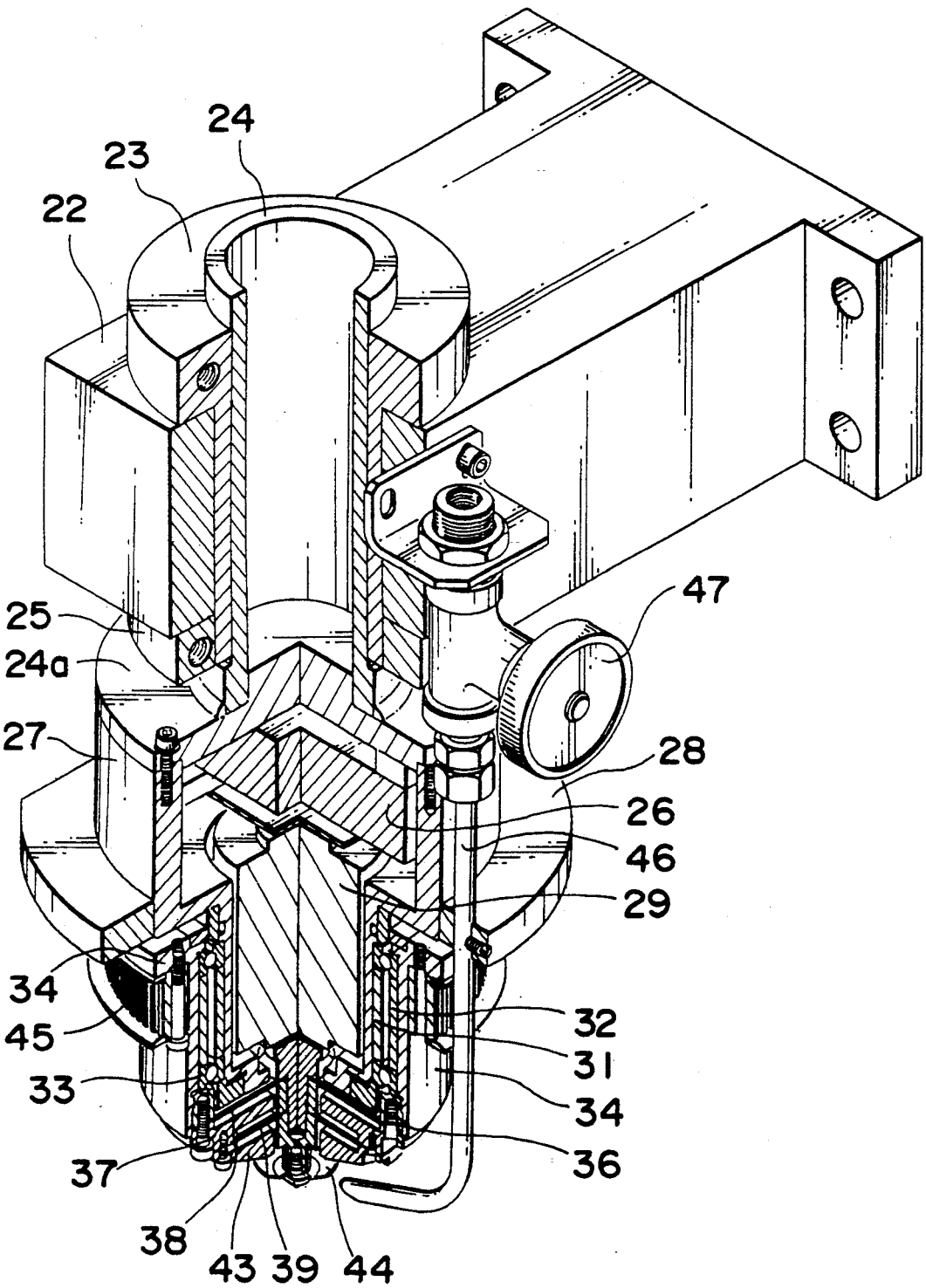
FIG. 2 is a perspective view, partly in section, of a spindle assembly according to the present invention.
Figure 3:
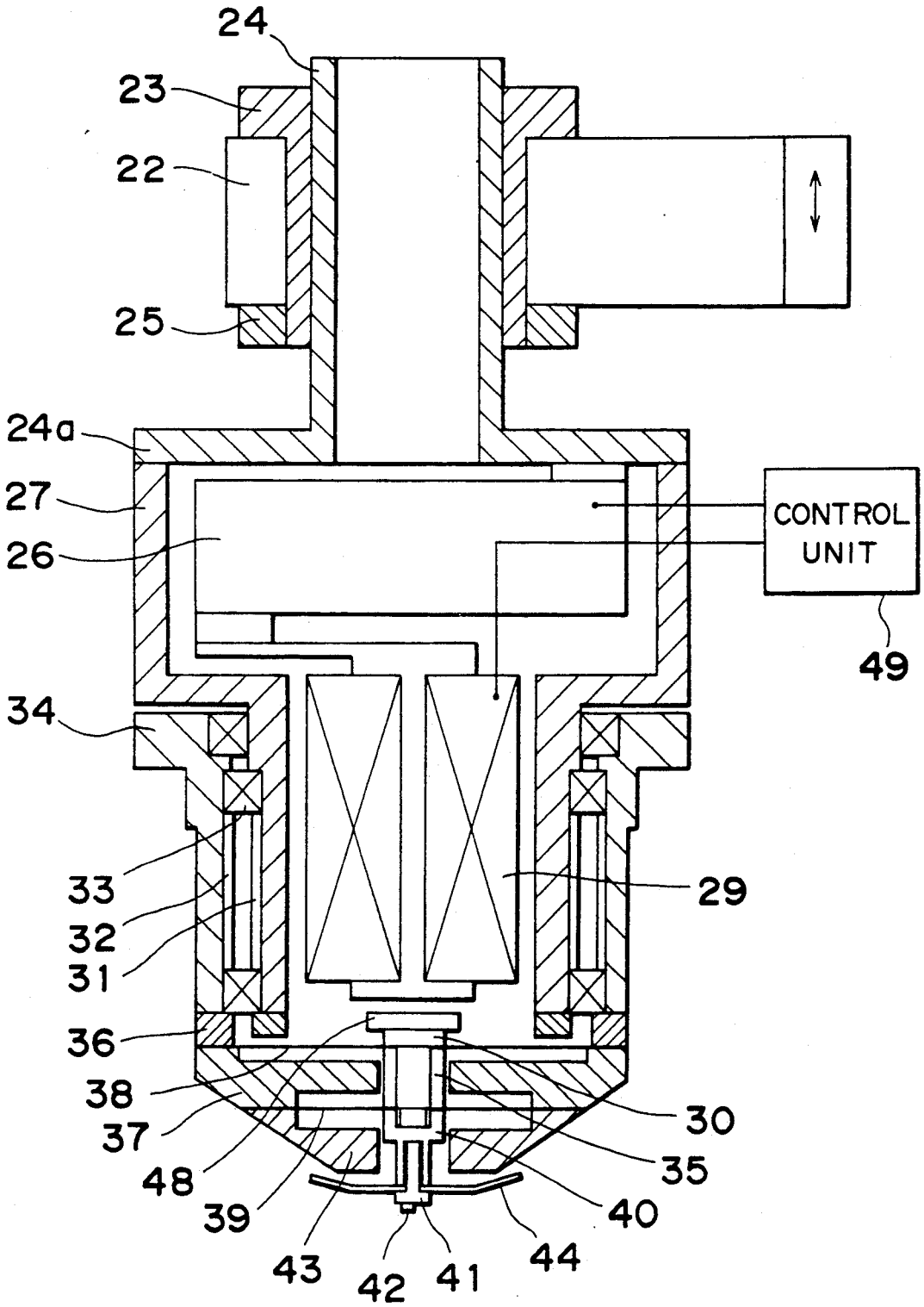
FIG. 3 is a schematic sectional view of a principal portion of the spindle assembly of FIG. 2.

Referring now to the drawings, there is shown in FIGS. 2 and 3 a spindle assembly according to the present invention, which is provided with a hollow spindle body 24 rigidly secured to a bracket 22 by means of a pair of split clamp rings 23 and 25. The spindle body 24 has a lower flange 24*a*, to which is rigidly secured a housing or shell 27. A load cell 26 and an electric magnet 29 located below the load cell 26 are accommodated in and protected by the shell 27. One end of the load cell 26 is secured to the spindle body 24, and the electric magnet 29 is secured to the other end of the load cell 26. A head cover 34 is rotatably mounted on the shell 27 via a bearing 33 and a pair of spacers 31 and 32. An external wheel of the bearing 33 is held by an external wheel holder 36 threaded in the head cover 34. On the external wheel holder 36 is mounted a first flat or plate spring 38, on which is further mounted a spacer 37. The external wheel holder 36, first plate spring 38, and spacer 37 are fastened to one another by means of a plurality of screws. On the spacer 37 is mounted a second flat or plate spring 39, on which is further mounted a plate holder 43. The spacer 37, second plate spring 39, and plate holder 43 are also fastened to one another by means of a plurality of screws. A timing pulley 45 is secured to the head cover 34 and is driven by a driving mechanism (not shown) to thereby rotate the head cover 34.

Preferably, each of the plate springs 38 and 39 are made of a circular thin plate having a thickness less than 0.2 mm and has a low spring constant at a location in the proximity of the center thereof.

Figure 4:
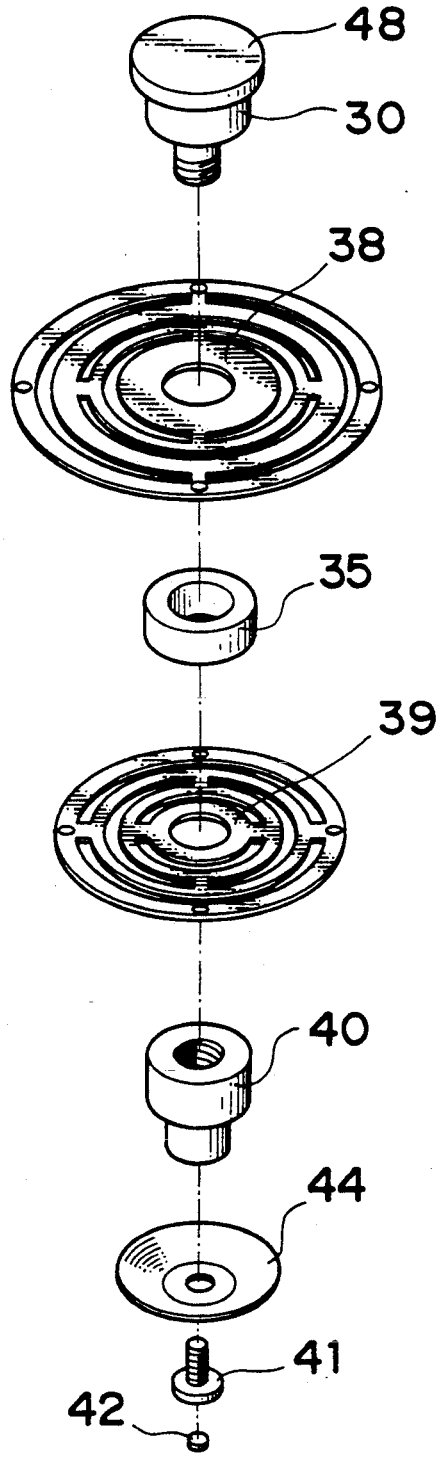
FIG. 4 is an exploded perspective view, on an enlarged scale, of a support assembly of an abrasive tool bonded to the spindle assembly of FIG. 2.

As best shown in FIG. 4, each of the plate springs 38 and 39 has a plurality of, for example first, second and third, concentric round rows of a pair of circumferentially extending arcuate openings defined therein in coaxial relationship with respective plate springs 38 or 39. The pair of the arcuate openings in one of the first to third round rows are offset 90° relative to the pair of the arcuate openings in the neighboring round rows either radially inwardly of or radially outwardly of such one of the first to third round rows.

A collar 35 is sandwiched between the plate springs 38 and 39, and these members are fastened to one another by a bolt 30 and a nut 40. A permanent magnet 48 is securely mounted on the head of the bolt 30. Into the lower end of the nut 40 is threaded a tool seat 41 for fastening a draining plate 44. An abrasive tool 42 made of, for example, urethane is bonded to the lower end of the tool seat 41. These members are concentrically aligned with the head cover 34.

As best shown in FIG. 4, the abrasive tool 42 is resiliently and vertically reciprocally supported on the head cover 34 via the plate springs 38 and 39 and the external wheel holder 36. The permanent magnet 48 and the electric magnet 29 are opposed to and spaced from each other with a predetermined gap defined therebetween so that the magnetic force generated by the former and that generated by the latter may repulse to each other.

To the external surface of the shell 27 is rigidly secured a nozzle holder 28 for holding a nozzle 46. The nozzle 46 has one end directed to the abrasive tool 42 and the other end connected to a flow control valve 47 rigidly secured to the bracket 22.

The spindle assembly having the above-described construction operates as follows.

Initially, a lens to be polished is placed below the spindle assembly and is rotated at a predetermined speed. At this moment, the rotational force transmitted to the timing pulley 45 from the driving mechanism rotates the head cover 34. The rotation of the head cover 34 rotates the external wheel holder 36 and the plate spring 38, thereby further rotating the permanent magnet 48, bolt 30, collar 35, spacers 32 and 37, plate spring 39, nut 40, draining plate 44, tool seat 41, and abrasive tool 42. In this way, the abrasive tool 42 can be rotated in synchronization with the rotation of the timing pulley 45.

Prior to the lowering of the entire spindle assembly, the electric magnet 29 is charged with electricity to generate a magnetic field, thereby biasing the permanent magnet 48 downwards. The downward movement of the permanent magnet 48 resiliently deforms both the plate springs 38 and 39 so that respective centers thereof protrude downwards.

Subsequently, when the bracket 22 is moved downwards by an apparatus body (not shown), the entire spindle assembly moves downwards, thereby bringing the abrasive tool 42 into contact with a lens disposed below the abrasive tool 42. When the entire spindle assembly is further moved downwards to bias the abrasive tool 42 against the lens, both the plate springs 38 and 39 are pushed upwards by virtue of the reaction force.

As a result, the distance between the permanent magnet 48 and the electric magnet 29 is shortened and respective repulsive magnetic forces increase, thereby exerting a compressive force (F) on the load cell 26. Because the correlation between the compressive force (F) measured by the load cell 26 and the pressure (f) applied (the actual contact pressure between the abrasive tool 42 and the lens) can be grasped in advance, the dynamic pressure (f) applied can be known by successively monitoring the compressive force (F).

When a local corrective polishing is performed by the application of a very small pressure $\Delta f$, this pressure $\Delta f$ can be maintained by feed-back controlling the voltage applied to the electric magnetic 29 so that the value measured by the load cell 26 may become equal to a compressive force $\Delta F$ corresponding to the pressure $\Delta f$. To this end, the apparatus body is provided with a control unit 49 electrically coupled with the electric magnet 29 and the load cell 26 so that the voltage applied to the electric magnet 29 may be controlled in response to a signal sent from the load cell 26. This control unit serves as a dynamic compensator during polishing and organizes a kind of force-control type servo system to make the pressure $\Delta f$ stable.

Under such conditions, the amount of a polishing solution is regulated by the flow control valve 47 and is injected towards the abrasive tool 42 through the nozzle 46 during polishing.

It is to be noted here that the abrasive tool 42 may be located at the center of the tool seat 41 or otherwise may be offset relative thereto. The offset arrangement of the abrasive tool 42 on the tool seat 41 enables the surface of a lens to be polished at a wider area than the case where the abrasive tool 42 is located at the center of the tool seat 41.

It is further to be noted that the lens to be polished may be rotated or otherwise may be placed stationarily. When the lens is rotated, the abrasive tool 42 polishes the lens in a direction circumferentially thereof. On the other hand, when the lens is placed stationarily, only a specified area thereof is subjected to the polishing.

It is also to be noted that although two plate springs are provided in the above-described embodiment, the number of plate springs may be one or three or more.

As is clear from the above, the spindle assembly according to the present invention has plate springs resiliently carrying the abrasive tool and no vertically movable spline shaft. The use of the plate springs prevents the radial movement of the abrasive tool and restrains the rotary members from swaying. Accordingly, it is possible to dynamically control the pressure applied to a lens to be polished even though the pressure is very small, thus enabling a partial corrective polishing in a limited small area.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein

What is claimed is:

1. A spindle assembly for use in a lens polisher for polishing a lens, said spindle assembly comprising:

a spindle body;

a housing secured to said spindle body;

a pressure monitoring means, accommodated in said housing and secured to said spindle body, for monitoring a pressure applied to the lens;

a rotary head rotatably mounted on said housing;

an electric magnet secured to said pressure monitoring means;

at least one plate spring resiliently carried by said rotary head;

a permanent magnet opposed to and spaced from said electric magnet, said permanent magnet being secured to said plate spring;

an abrasive tool, secured to said plate spring, for polishing the lens; and a control means, electrically coupled with said electric magnet and said pressure monitoring means, for controlling a voltage applied to the electric magnet in response to a signal sent from said pressure monitoring means, whereby a magnetic force generated by said electric magnet and a magnetic force generated by said permanent magnet repulse to each other, thereby resiliently biasing said abrasive tool against the lens during polishing while the pressure applied to the lens is being monitored by said pressure monitoring means and is being controlled by said control means.

2. The spindle assembly according to claim 1, wherein said plate spring has a plurality of concentric round rows of a pair of circumferentially extending arcuate openings defined therein in coaxial relationship with said plate spring.

3. The spindle assembly according to claim 1, wherein said abrasive tool is positioned at a center of said rotary head.

4. The spindle assembly according to claim 1, wherein said abrasive tool is offset from a center of said rotary head.

* * * * *